US006253468B1

(12) United States Patent
Hirota

(10) Patent No.: US 6,253,468 B1
(45) Date of Patent: Jul. 3, 2001

(54) SPIKE STRUCTURE FOR SPORTING SHOES

(75) Inventor: Kashichi Hirota, Hachioji (JP)

(73) Assignee: Kyowa Electric and Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/597,688

(22) Filed: Jun. 19, 2000

(30) Foreign Application Priority Data

Jul. 14, 1999 (JP) ..... 11-199933

(51) Int. Cl.[7] ..... A43C 15/02
(52) U.S. Cl. ..... 36/134; 36/127; 36/67 D
(58) Field of Search ..... 36/67 R, 67 A, 36/67 D, 127, 134, 59 A, 59 B

(56) References Cited

U.S. PATENT DOCUMENTS 3,195,246 * 7/1965 Ueda ..... 36/134
3,715,817 * 2/1973 White et al. ..... 36/67 D
5,025,576 * 6/1991 Biasiotto et al. ..... 36/134
5,386,651 * 2/1995 Okamoto ..... 36/134
5,964,048 * 10/1999 Shich ..... 36/134
6,006,454 * 12/1999 Sitzler, Sr. ..... 36/127

FOREIGN PATENT DOCUMENTS 11009306 1/1999 (JP) .

* cited by examiner

*Primary Examiner*—M. D. Patterson
(74) *Attorney, Agent, or Firm*—Jacobson Holman PLLC

(57) ABSTRACT

A spike structure consists of a spike body made of a plastic material, and a self-tapping screw 3 made of a metal. The spike body 2 is comprised of a flange-shaped portion 4 and a threaded stud which has a thread on the outer surface thereof and extends from one surface of said flange-shaped portion 4. An axial bore is formed through the flange-shaped portion 4 and the threaded stud 5, while slits are formed in said threaded stud 5, extending to the free end of said threaded stud. A self-tapping screw 3 is inserted with tapping into the axial bore to be fixed to said spike body. Said self-tapping screw 3 is configurated to stretch said threaded stud radially outwardly when inserted into the axial bore of spike body.

4 Claims, 3 Drawing Sheets

SPIKE STRUCTURE FOR SPORTING SHOES

FIELD OF THE INVENTION

This invention relates to a spike structure for sporting shoes such as golf shoes. More particularly, this invention relates to sporting shoe spikes that substitute for metal spikes.

BACKGROUND OF THE INVENTION

A golf shoe, for example, has metal spikes which are screwed into a shoe sole to be secured thereto. It has been pointed out that this kind of shoe has a problem that the metal spikes could damage greens of a golf course. Therefore, a recent trend is to use spikeless shoes having a shoe sole formed integrally with protrusions made of a plastic material. However, such shoe sole structure having protrusions integral with the sole requires to replace the whole shoe sole when the protrusions have worn.

To solve this problem, the structure may be that spikes made of a plastic material are screwed into shoe soles. However, in the case where such plastic spikes are screwed into the shoe sole in a manner similar to that of metal spikes, there may be a practical problem that loosening may easily occur in use, due to the physical properties of the material used for the spikes. To solve the problem, Japanese patent laid-open publication No. Hei 11-9306 has proposed that an sporting shoe spike can consist of a body made of a plastic material, and a core made of a metal material. In the proposed structure, the body is comprised of a flange-shaped portion and a threaded stud which extends from one surface of said flange-shaped portion and has a thread on an outer surface of the stud. An axial bore is formed to extend through a flange-shaped portion and the threaded stud, while a slit is formed to extend axially to the free end of the stud. A core is inserted into the axial bore to be fixed to the body. The core is configurated to make the stud to expand radially outwardly when inserted in the axal bore of the body. Further, the flage-shaped portion of the spike body has a plurality of spike protrusions formed on the other surface thereof opposite the threaded stud.

SUMMARY OF THE INVENTION

It is an object of this invention to cope more effectively with the loosening problem in use in the case where sporting shoes such as golf shoes are provided with spikes made of a plastic material, and to provide a novel spike structure which can more effectively solve the loosening problem in use even with the primary portion of the spike is made of a plastic material.

In order to solve the problem described above, this invention improves the structure disclosed in Japanese patent laid-open publication No. Hei 11-9306, by having a core in the form of a self-tapping screw.

In one preferred embodiment of the invention, the spike has a flange-shaped portion having one surface formed with spike protrusions and of a convex shape having a high central portion gradually lowering to the edge. A core is preferably formed to be tapered toward the free end of a threaded stud of a spike body to make the spike body to expand radially outwardly at the base area of the threaded stud adjacent to the flange-shaped portion.

In another embodiment of the invention, an axial bore formed in the spike body includes a large diameter portion opening to the surface having the spike protrusions, and a small diameter portion formed in the threaded stud, the core being formed to include a flange which is adapted to sit on a shoulder formed between the large and small diameter portions. Two slits are preferably provided at the diametrically opposing sides in the threaded stud.

Plastic material composing the spike body in this invention, is preferably a urethane type elastomer material, but other type of plastic materials may be used. The core is preferably formed of a corrosion-resistant iron based material such as a stainless steel.

According to the present invention, the spike for sporting shoes has a spike body made of a plastic material, so that male threads on the threaded stud are also made of a plastic material. However, in the spike structure, the threaded stud is formed with axial slits extending to the free end, and secured by a self-tapping screw of a metallic material by being forced to expand radially outwardly from inside. It is therefore possible, when screwed into the bore of the shoe sole, to prevent the spike from being loosened in use. Further, the metal self-tapping screw may have a tip end of the screw protruding from the spike protrusion, it may be possible to prevent slipping by the protruding tip of the metal core material when walking on slopes.

BRIEF DESCRIPTION OF THE DRAWINGS

FIG. 1 shows a spike of a golf shoe according to one embodiment of this invention, wherein

FIG. 2 shows a spike body of a spike according to the embodiment of this invention, wherein

FIG. 3 shows a self-tapping screw of the spike according to the embodiment of this invention, wherein

DETAILED DESCRIPTION OF THE PREFERRED EMBODIMENTS

Figure 1A:
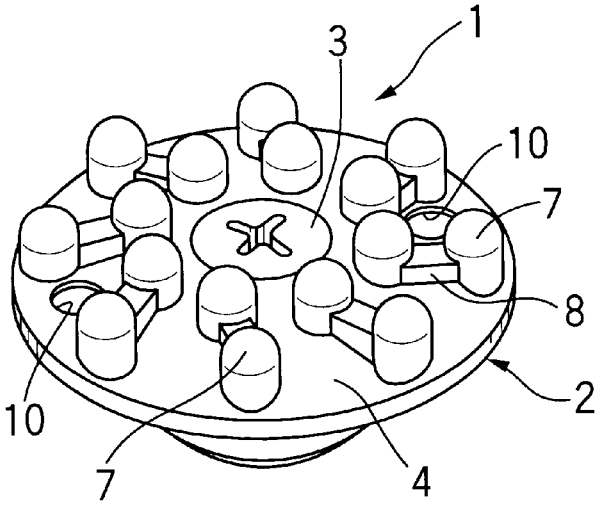
FIG. 1*a* is a perspective view and FIG. 1*b* is a partially cut-away side elevational view.
Figure 1B:
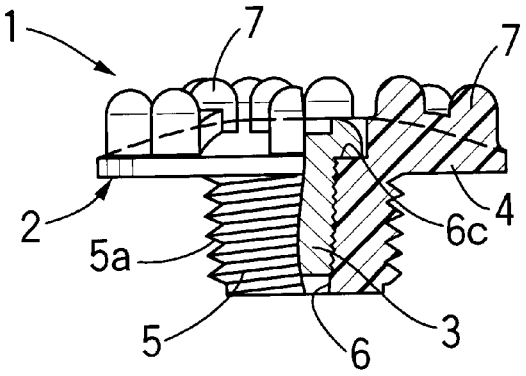

The invention will now be described with reference to a spike for golf shoes taking reference to the accompanying drawings showing one embodiment of the invention. Referring to FIG. 1*a* and FIG. 1*b*, a golf shoe spike 1 in this embodiment of the invention, consists of a spike body 2 and a self-tapping screw 3.

Figure 2A:
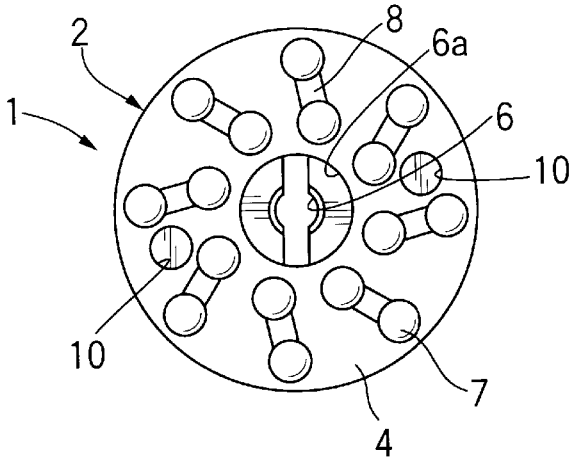
FIG. 2*a* is a top plan view.
Figure 2B:
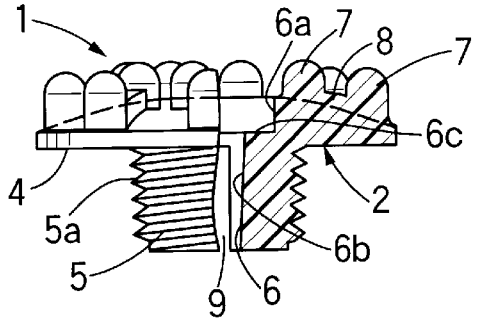
FIG. 2*b* is a partially cut-away side elevational view.
Figure 2C:
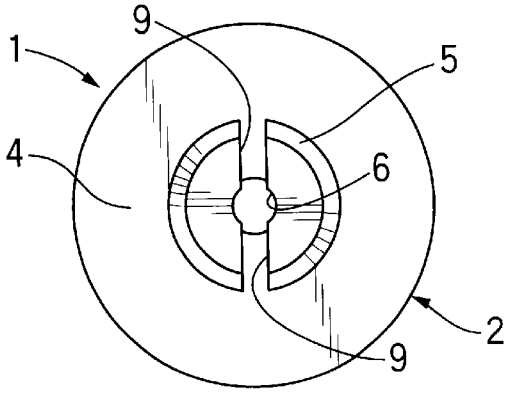
FIG. 2*c* is a bottom plan view.

FIG. 2*a*, FIG. 2*b* and FIG. 2*c* show the spike body 2, which is made of a plastic material such as a urethane type elastomer material. The spike body 2 includes a flange-shaped portion 4 of a disk shape and a threaded stud 5 extending perpendicularly from one surface of the flange-shaped portion. The threaded stud 5 has a male thread on the outer surface thereof as shown in FIG. 2*b*. An axial bore is formed in the spike body 2, axially through the flange-shaped portion 4 and the threaded stud 5. The axial bore 6 is comprised of a large diameter portion 6*a* opening onto the surface of the flange-shaped portion opposite to the threaded stud and a small diameter portion 6*c* penetrating the threaded stud 5. A shoulder area is formed between the large diameter portion 6*a* and the small diameter portion 6*b* of the axial bore 6.

As shown in FIG. 2*b*, the surface of the flange-shaped portion 4 of the spike body 2 opposite to the threaded stud 5 has a convex shape having a high central portion and a peripheral portion lowering to the edge. A plurality of spike protrusions 7 are formed on the convex surface. Each tip of spike protrusions 7 is arranged, as similar to the outline of the curved surface of the flange-shaped portion, with the highest protrusion 7 at the center of said flange-shaped portion and lower protrusions at the edge. As shown in FIG. 1*a* and FIG. 2*a*, two adjacent spike protrusions 7 are interconnected by a rib 8. The rib 8 provides greater rigidity of spike protrusions 7.

As shown in FIG. 2*c*, a threaded stud 5 has axial slits 9 at diametrically opposing sides. The slits 9 are formed substantially throughout the length of the threaded stud 5. Referring to FIG. 2*b*, a small diameter portion 6*b* of the axial bore 6 is slightly tapered to the free end, the diameter of the axial bore at the end adjacent to the large diameter portion 6*a* is greater than the diameter at the other end. Further, a pair of installation tool receiving holes 10 are provided at diametrically opposite portions in the curved surface of the flange-shaped portion 4, shown in FIG. 1*a* and FIG. 2*a*.

Figure 3A:
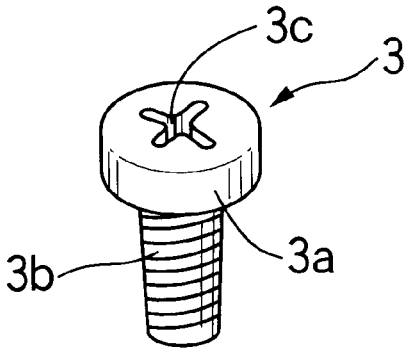
FIG. 3*a* is a perspective view and FIG. 3*b* is a partially cut-away side elevational view.
Figure 3B:
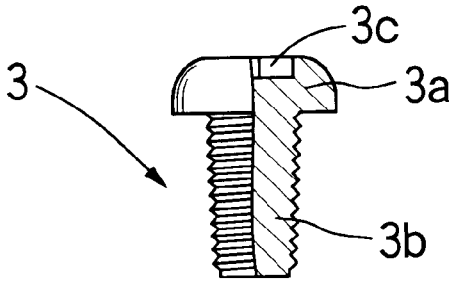

FIG. 3*a*, and FIG. 3*b* discloses a self-tapping screw 3, with right half in section. The self-tapping screw 3 includes a threaded stem 3*b* having a tapered shape with a decreasing diameter from the base area of the stem adjacent to a head portion 3*a* to the tip thereof. The threaded stem 3*b* has a slightly larger diameter at the base area than that of the small diameter portion 6*b* of the axial bore 6 at the shoulder area 6*c* , and has a diameter at the tip larger than that of the tip of the small diameter portion 6*b* of the axial bore 6. The self-tapping screw has a cross-shaped recess on the head portion 3*a*.

FIG. 1*b* shows the spike of this embodiment in an assembled state. The self-tapping screw 3 is screwed into the axial bore 6 of the spike body 2 from the side of the flange-shaped portion. Meanwhile, the self-tapping screw 3 taps the inner surface of the small diameter portion 6*b* of the axial bore of the spike body, by the tapping screw of the threaded stem 3*b*. The insertion of a self-tapping screw is finished when the head portion 3*a* of the self-tapping screw 3 sits on the shoulder area 6*c* formed on the axial bore of the spike body. At this moment, since the diameter of the threaded stem 3*b* of the self-tapping screw 3 at the base area is larger than that of the small diameter portion 6*b* of the axial bore of the spike body, and the threaded stud 5 of the spike body is formed with the slits 9, the threaded stud 5 is forced to expand radially outwardly to be secured by the self-tapping screw 3 from the inside.

The insertion of self-tapping screw 3 described above is conducted after the body 2 has been screwed into the threaded bore (not shown) in the sole of a golf shoe. The body 2 can be screwed into the threaded bore of the shoe sole by using a tool conventionally adopted for installing spikes to golf shoe. In this instance, a pair of tool pins may be engaged with holes 10 in the flange-shaped portion 4 and rotated. The spike in accordance with the embodiment of the invention has the spike body made of a plastic material, however, there is no likelihood that the spike is loosened in use since the self-tapping screw made of a metal functions to force the threaded stud 5 from the inside maintaining it in a radially outwardly expanded position. Further more, since the spike is mostly made of a plastic material, it will not damage grass of golf courses. Still further, the exchange of the worn spike protrusions on the spike body is possible as well as ordinary spikes. Also, the self-tapping screw 3 is screwed into a threaded stud 5 of the spike body 2, so that the self-tapping screw 3 will not be loosened in use.

Having described the invention with reference to an embodiment shown in the accompanying drawings, it should be understood that the invention should not be limited by any of the details of construction of the embodiment.

What is claimed is:

1. An spike for sporting shoes including, a spike body made of a plastic material and having a flange-shaped portion, a threaded stud extending from one surface of said flange-shaped portion and having a thread on an outer surface thereof, an axial bore formed through said flange-shaped portion and said threaded stud, and at least one slit formed in said threaded stud; and, a metal core inserted into said axial bore of said spike body to be fixed to said spike body;

said flange-shaped portion having spike protrusions on the other surface opposite to said threaded stud;

said core being configured to force said threaded stud radially outwardly when inserted into said axial bore of said spike body;

said core consisting of a self-tapping screw, which is adapted to be screwed into said axial bore of said spike body with a thread tapping action against an inter surface of said axial bore.

2. The sporting shoe spike according to claim 1, wherein said self-tapping screw is tapered to the free end of said threaded stud of said spike body, and forces a base area of said threaded stud adjacent to said flang-shaped portion to expand radially outwardly.

3. The sporting shoe spike according to claim 1, wherein an axial bore formed in said spike body includes a large diameter portion opening onto the surface of said flange-shaped portion having said spike protrusions and a small diameter portion formed in the threaded stud, said self-tapping screw having a head portion adapted to sit on a shoulder area formed between said large diameter portion and said small diameter portion.

4. The sporting shoe spike according to claim 1, wherein two slits are formed on diametrically opposite sides in said threaded stud.

* * * * *